United States Patent [19]

Berger

[11] Patent Number: 4,972,788

[45] Date of Patent: Nov. 27, 1990

[54] AQUATIC VEHICLE

[76] Inventor: Leo Berger, Kashaldenstr. 31, CH-8052 Zurich, Switzerland

[21] Appl. No.: 324,432

[22] Filed: Mar. 16, 1989

[30] Foreign Application Priority Data

Mar. 18, 1988 [DE] Fed. Rep. of Germany ..... 3809158

[51] Int. Cl.[5] ..... B63B 1/12; B63B 39/03

[52] U.S. Cl. ..... 114/61; 114/125

[58] Field of Search ..... 114/39.1, 61, 125

[56] References Cited

U.S. PATENT DOCUMENTS

| | | | |
|---|---|---|---|
| 1,152,654 | 9/1915 | Nosworthy et al. | 114/125 |
| 1,709,219 | 4/1929 | Hille | 114/39.1 |
| 2,997,974 | 8/1961 | Hamlin | 114/61 X |
| 3,116,708 | 1/1964 | Gardhouse | 114/39.1 X |
| 3,137,263 | 6/1964 | Sainte-Claire | 114/125 |
| 3,186,371 | 6/1965 | Moore | 114/125 |
| 3,,304,898 | 2/1967 | Sainte-Claire | 114/125 X |
| 4,001,905 | 1/1977 | Givens | 114/125 X |
| 4,541,356 | 9/1985 | Jones et al. | 114/125 X |

FOREIGN PATENT DOCUMENTS 7416503 5/1974 Fed. Rep. of Germany .

*Primary Examiner*—Sherman Basinger
*Attorney, Agent, or Firm*—Bachman & LaPointe

[57] ABSTRACT

In an aquatic vehicle with one or more hulls, a chamber (10) is formed in the boat or hull (19, 7). The chamber has at least one opening (13) which can be closed via a closing element (14) and at least one vent (20). The closing element (14) opens the opening (13) by itself when the boat or hull (19, 7) is immersed in the water and closes it by itself when the boat or hull (19, 7) is raised out of the water.

17 Claims, 3 Drawing Sheets

Fig. 1
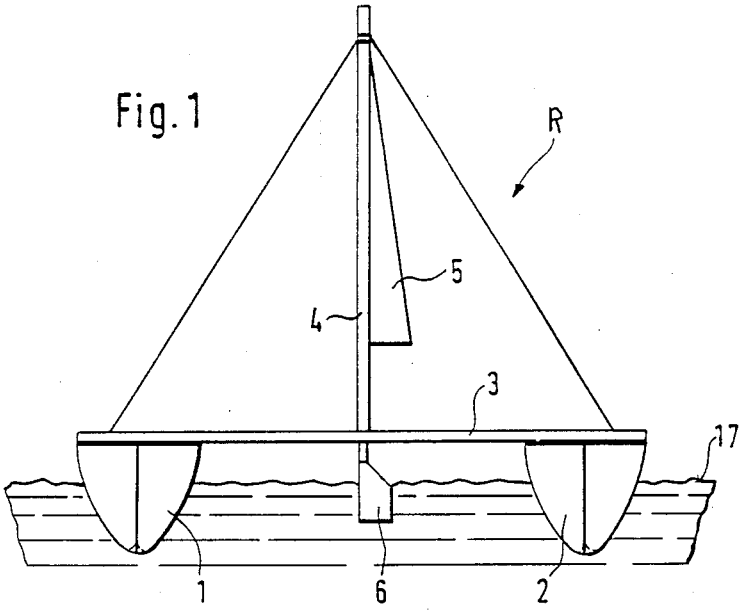
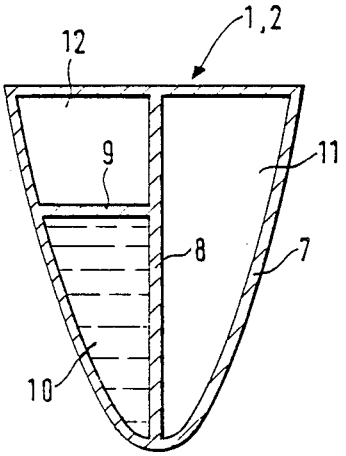
Fig. 2
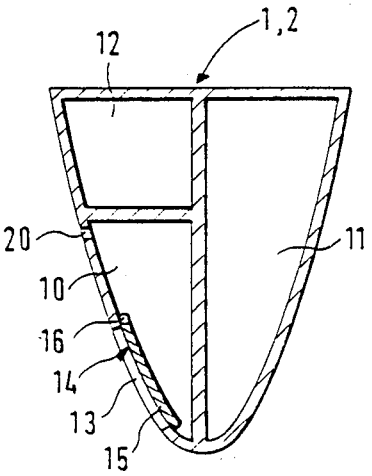
Fig. 3

Fig. 4
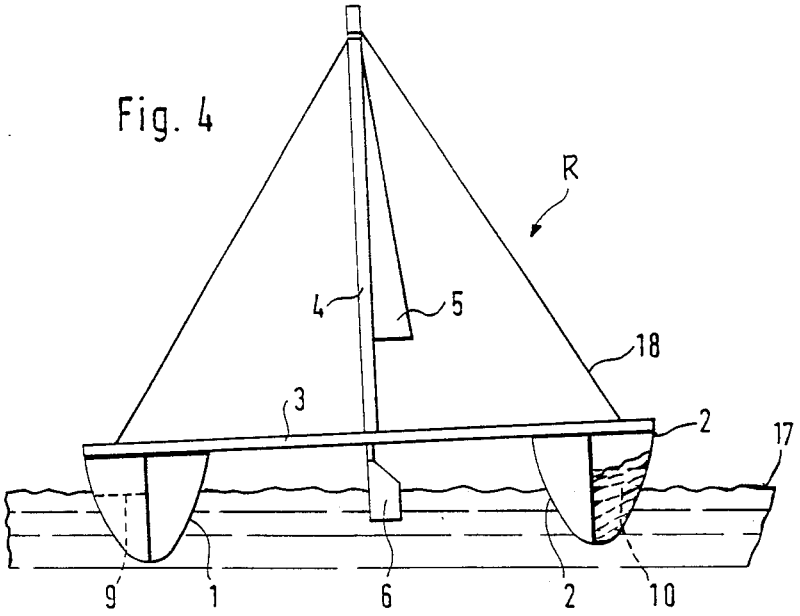
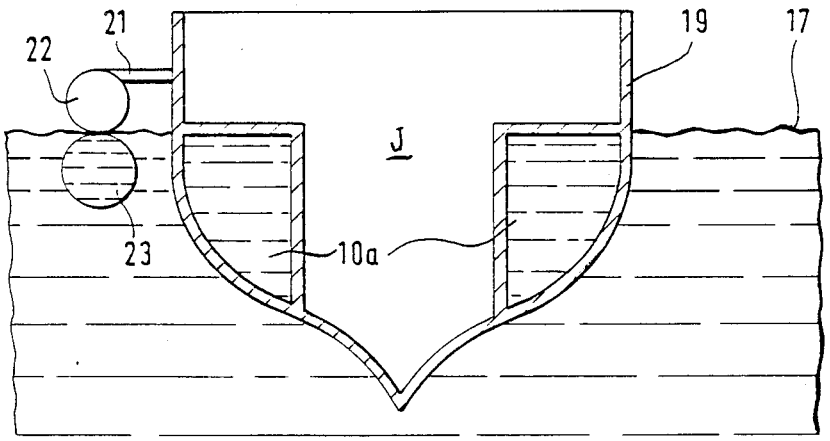
Fig. 5

AQUATIC VEHICLE

BACKGROUND OF THE INVENTION

The invention relates to an aquatic vehicle with one or more hulls, a chamber being formed in or on the boat or hull, which chamber has at least one opening, which can be closed via a closing element, and at least one vent.

Many forms of such aquatic vehicles are known. Sailing boats in particular have the problem that in a strong wind considerable weight must be shifted to one side of the boat in order to counteract the pressure of the wind on the sails. The crew members then usually hang over the gunnel on, for example, trapeze harnesses.

The problem described above manifests itself in particular on catamarans, where the body floating on the water consists of two hulls. In a strong wind, it is often found that one hull is even raised out of the water during sailing in this wind.

In this case also, only a shift in weight to the appropriate side of the catamaran helps, which to date is again effected only by crew members.

A catamaran with a water-tank counterbalance is known, for example, from German Utility Model No. 7,416,503. In this, each float of the catamaran has a partition, it being possible for one chamber to be filled with water from the top. This is cumbersome, since on the one hand during filling water must be introduced into the appropriate chamber by the boat crew, and on the other hand to empty the water the float must be rotated through about 180°.

U.S. Pat. No. 1,709,219 provides an improvement in this respect, two floats likewise being provided alongside one boat body. Each float consists of a chamber which can be filled with water. Filling is effected through a flap which is opened outwards via corresponding lever rods. Here again, filling of this chamber thus requires its own working operation.

SUMMARY OF THE INVENTION

The objective of the inventor was to develop an aquatic vehicle in which this problem is counteracted by a simple means, that is to say in which weight takes effect on that side of the boat which wants to lift out of the water.

To achieve this objective, a chamber which has closable openings is formed in or on the boat or hull.

This simple invention ensures that when the boat or hull is immersed, water enters the chamber. As long as the boat or hull is in the water, the weight of the water in the chamber has no effect. The boat or hull is merely immersed slightly deeper in the water, which is to be attributed to the loss in volume from the buoyancy tank volume, which of course can be compensated for by a larger buoyancy tank volume.

According to the invention, each opening is provided with a closing element. This closing element is constructed so that it closes the opening at the moment at which the boat or hull is raised in the water. The weight of the water in the chamber becomes effective at the moment at which the water level in the chamber is raised above the water level of the water surrounding the boat or hull. This raising only happens if, for example in the case of a catamaran, one hull is raised out of the water in a strong wind. In this case, the higher the hull rises out of the water, the greater the effective weight in the chamber. This is an essential advantage of the invention.

For simplicity, the closing element provided is a flap connected to the boat or hull via a hinge or the like. Thus, when the boat or hull is placed in the water, the flap opens due to the external pressure of the water. The water fills the chamber up to a water level which corresponds to that of the surrounding water.

However, if the boat or hull is raised out of the water, the internal pressure of the water in the chamber on the flap thus also increases, so that this closes by itself. Additional sealing tapes around the opening are conceivable.

This independent opening and closing of the opening by the closing element is an essential part of the invention, since no activity at all on the part of the boat crew is needed for this purpose. More luxurious embodiments which can operate, for example, pneumatically or hydraulically are of course also conceivable for the closing element. However, they will not be dealt with here, because the embodiment according to the invention represents the least expensive possible solution.

The location of the chamber in the boat or hull also plays a minor role in the context of the invention. It should without doubt be as far on the outside as possible, since the weight circumstances can in this way be influenced the most favorably.

Which part and which volume the chamber occupies in the boat or hull depends on the type of aquatic vehicle. In the case of a catamaran hull, for example, it will be necessary to provide sufficient additional buoyancy tanks around the chamber.

In order to render the present inventive idea useful also for already existing boats, according to the invention appropriate water-accommodating chambers can be connected to the boat or hull via supporting elements.

The supporting elements are fixed to the boat or hull in any desired manner. In order to increase the position of stability of the aquatic vehicle, a further provision is that an additional buoyancy tank which floats on the water line in the use position is also located between the water-accommodating tank and the support.

In another embodiment example of the invention, the hull is constructed rotatably.

In the simplest embodiment example of the invention, the closable opening moves above the water surface by rotation of the hull, so that, for example, it can be opened manually and some of the water present in the chamber can be drained off.

In the context of the invention, how the rotatability of the hull is ensured is not of paramount importance. For example, it is conceivable to suspend the hull on a stirrup, the hull being suitably mounted with respect to the stirrup. This stirrup can then at the same time grip underneath a seat or be connected to the boat on a support. However, no limit to the inventive idea is intended here.

It is furthermore conceivable for an axis of rotation connected at the same time to the stirrup to pass through the hull. The hull can in this manner rotate around this axis of rotation in suitable roller bearings.

However, in order further to increase the possibility of reducing weight, it is necessary to be able to remove as much water as possible from the chamber. To ensure this, the chamber has a connection to a discharge line, this discharge line being located approximately in the plane of one membrane and approximately perpendicular to the other membrane. This discharge line can of course also additionally be at an angle in order to improve drainage of the water from the chamber. Here again, the intention is not to be limited to this embodiment example but should include all possibilities by means of which water can be removed from the chamber.

In the present embodiment example the discharge line on the one hand ensures equilibration of the air when the chamber is filled. However, if the hull is rotated through 90° , the discharge line serves to drain the water out of the chamber. It may be that the discharge line initially still emerges from the hull below the water line. It is easy to understand that when water is discharged the hull rises and the discharge line thus also moves above the water line, which means that draining of the water is accelerated.

In the context of the invention, how the rotation of the hull is brought about plays no major role. It should be effected as simply as possible, and a drive is without doubt necessary. This drive can be linked to the rotating axis of the hull via appropriate drive elements or the like. A very simple embodiment example consists of a drive wheel over which is laid a cable or chain which encircles the hull and is fixed to the lower apex of the hull.

If the drive wheel is then rotated manually, for example, the hull follows this rotation, drawn by the cable.

Further advantages, features and details of the invention can be seen from the following description of the preferred embodiment example and with the aid of the drawings.

BRIEF DESCRIPTION OF THE DRAWINGS

FIG. 1 a front view of a catamaran;

FIG. 2 a magnified cross section through a hull of a catamaran;

FIG. 3 a further cross section through the hull of a catamaran according to FIG. 2 at another point;

FIG. 4 a front view of a catamaran in the use position with a partly cut-out hull;

FIG. 5 a simplified cross section through a boat with the device according to the invention;

DETAILED DESCRIPTION

Figure 6:
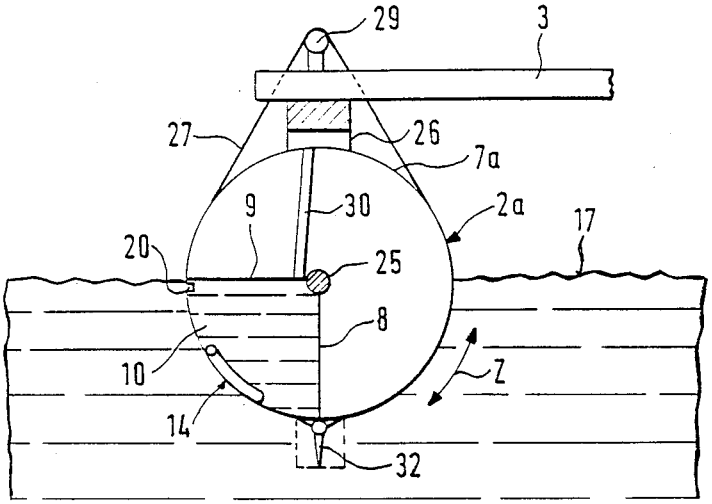
FIG. 6 a magnified cross section through another embodiment example of a hull.

According to FIG. 1, a catamaran K in a simplified embodiment consists of a left-hand hull 1 and a right-hand hull 2, a seat 3 connecting the two hulls 1 and 2, a mast 4 with a sail 5 and a rudder blade 6. When travelling normally, hull 1 and hull 2 are immersed to about the same degree in a water surface 17.

According to FIGS. 2 and 3 each hull ½ has a hull body 7, in which a chamber 10 which can be filled with water is separated from buoyancy tanks 11 and 12 by corresponding membranes 8 and 9.

As can be seen from FIG. 3, the chamber 10 has openings 13 which can be opened or closed by closing elements 14. In the present embodiment example, the closing element consists of a simple flap 15 which rotates about a hinge 16. Possible sealing elements on which the flap 15 lies and with which it achieves a sealing effect for the chamber 10 are not shown.

The closing elements 14 are constructed so that the chamber 10 can fill with water when the hull 1 or 2 is placed on a water surface. The level of water in the chamber 10 approximately corresponds here to that of the water line 17. This ensures that the travel of the catamaran is in no way impaired. Air holes 20 are provided in order to facilitate penetration of water into the chamber 10.

If, however, the catamaran K raises itself with one hull 2, for example in a fairly strong wind, as shown in FIG. 4, the water present in the chamber 10 presses against the flap 15 and in this way closes the openings 13. The water thus cannot flow out of the chamber 10 but loads the hull 2 by its weight. This weight has more effect the more the ramp 2 is raised out of the water, so that, for example, trapezing of the crew on shrouds 18 above the edge of the catamaran K is in many cases avoided or at least reduced.

If, the catamaran K is to be taken out of the water, it is sufficient, for example, to push open a few closing flaps 15 manually, so that the water present in the chamber 10 can flow out through the openings 13. All possible conceivable other closing elements which can be operated as required manually or even by servomotors or the like of course also lie within the context of the invention. The present embodiment shows, however, an exceptionally simple and therefore inexpensive embodiment example.

The inventive idea is not limited to a catamaran, however, but can also be applied to any other boat. This is illustrated in FIG. 5, where a cross section through a boat hull 19 is shown. Here again, chambers **10*a* are provided in the interior J which, after universion of the boat hull 19** in the water, can be filled with water by closable openings, which are not shown in more detail. This water in turn then acts as a weight if, for example, the boat heels as result of too strong a wind.

FIG. 5 furthermore shows schematically the conversion of already existing boat hulls with the device according to the invention. For this, buoyancy tanks 22 which in the use position float on the water line 17 are suspended on a support 21. Water-accommodating chambers 23 are connected to the buoyancy tanks 22. These water-accommodating chambers have devices similar to those described above for the chambers 10. These ensure entry and discharge of water. Functioning of the water-accommodating chambers 23 is likewise the same as that of the chambers 10.

Figure 7:
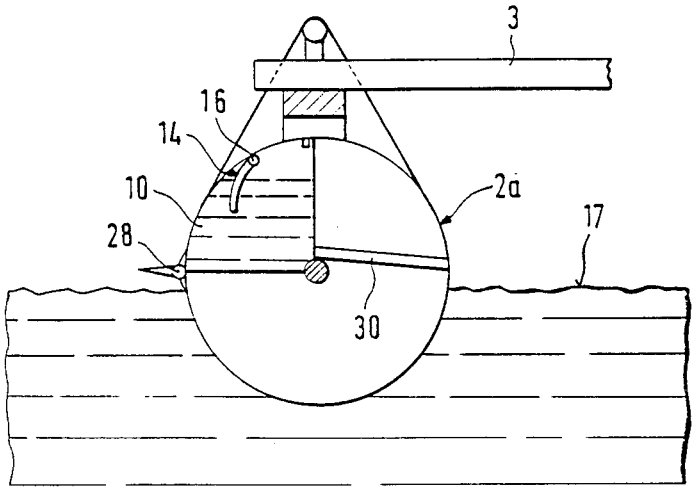
FIG. 7 a cross section through the hull according to FIG. 6 in another use position.

Another embodiment example of a hull **2*a* is shown in FIGS. 6 and 7. Here the hull body 7*a* is cylindrical in construction, but the corresponding membranes 8 and 9 are provided within the hull body 7*a*. These membranes 8 and 9 in turn form the boundary of the chamber 10, which has openings, not shown in more detail, covered by the closing elements 14**.

This hull **2*a* has an axis of rotation 25 around which the hull 2*a* can be rotated in the direction z. The axis of rotation 25 is connected to a stirrup 26, which connection is not shown in more detail, which grips axially parallel around the hull 2*a*. The seat 3 lies on the stirrup 26**.

Other embodiments which ensure that the hull **2*a*** can be rotated also lie within the context of the invention.

The rotation of the hull **2*a* in the direction z in the simplest embodiment example shown here is effected by a cable 27 or a chain which encircles the hull 2*a* and is fixed to a corresponding eye 28. A wheel 29 over which the cable 27 is passed is provided on the seat 3. This wheel 29** is allocated a drive, which is not shown for simplicity, it being possible for this drive to be affected manually, electrically, pneumatically or hydraulically.

In the use position shown in FIG. 6, discharge openings 30 which allow filling of the chamber 10 lead upwards.

If, for example, the wind subsides so that additional ballast in the hull 2*a* is not necessary, the hull 2*a* can be rotated in the direction z around its axis of rotation 25. After rotation through 90°, it reaches the position shown in FIG. 7. The water in this way pushes out of the chamber through the discharge lines 30 and is thus removed to the outside. As a result of the continual draining of the water from the chamber 10, the weight of the hull 2*a* is reduced, so that this raises itself out of the water and the discharge lines 30 in particular move above the water line 17. Draining of the water is in this way facilitated further. The closing element 14 moreover flips open by itself by rotation around the hinge 16, so that sufficient air equilibration is ensured.

In the context of the invention, it is of course conceivable also to allow only partial filling of the chamber 10 in this manner, depending on the wind strength.

Although in FIGS. 6 and 7 the embodiment last referred to relates to the hull 2*a*, it is specifically conceivable also to position this embodiment instead of the buoyancy tanks 22 and water-accommodating chambers 23 in the embodiment example according to FIG. 5 and thus to convert boat hulls.

Both filling and emptying of the chamber 10 is improved further by at least one additional air hole 20.

The inventor has furthermore developed another very simple possibility of enabling the hull 2*a* to rotate. The hull 2*a* usually has a keel 32 which when gliding is located in the longitudinal direction of the hull 2*a*. If this keel 32 is rotated out of the direction of travel, as indicated by the broken line, the hull 2*a* rotates by itself. How the rotation of the keel 32 is produced is of no significance in the context of the invention.

I claim:

1. A multi-hulled boat comprising: two spaced apart hulls;

each said hull having a water accommodating chamber and at least one buoyancy tank;

each said water chamber having an opening for permitting water to enter said chamber and an element for closing said opening;

said closing element being formed by a flap member hinged to an inner portion of said hull; and said closing element permitting the entry of water into said chamber through said opening when said hull is immersed in said water and closing said opening when said hull is raised out of said water as a result of water pressure in said chamber.

2. A boat as in claim 1 in which said closing element opens said opening by itself when said hull is immersed in the water.

3. A boat as in claim 1 in which each said hull is rotatably constructed.

4. A boat as in claim 3 in which each said hull is fixed to a respective stirrup.

5. A boat as in claim 4 in which each said stirrup is connected to a bottom side of a seat.

6. A boat as in claim 4 in which each said stirrup is mounted to a support structure.

7. A boat as in claim 3 wherein each said hull rotates about an axis of rotation.

8. A boat as in claim 3 further comprising:

a discharge line within each said hull; and said discharge line communicating with said water accommodating chamber within said hull.

9. A boat as in claim 8 further comprising:

each said hull having a membrane forming a wall of said water accommodating chamber; and said discharge line being located in approximately the plane of said membrane.

10. A boat as in claim 8 further comprising:

each said hull having a membrane forming a wall of said water accommodating chamber; and said discharge line being located at an angle relative to said membrane.

11. A boat as in claim 8 wherein said discharge line insures air equilibration when said water accommodating chamber is filled and ensures water drainage out of said chamber when said hull is rotated through about 90°.

12. A boat as in claim 3 wherein:

each said hull has a drive wheel connected thereto for rotating said hull in a desired direction of rotation.

13. A boat as in claim 12 wherein:

each said hull has cable means passing from said drive wheel around said hull; and said cable means being connected to an eye on said hull.

14. A boat as in claim 3 wherein:

each said hull has a keel which can be rotated around an axis; and said keel rotation axis being substantially perpendicular to an axis about which said hull is rotated.

15. A boat as in claim 1 wherein each said flap member is hinged to said hull at an upper end of said member.

16. A boat as in claim 1 further comprising:

an air hole in each said hull; and said air hole communicating with said water accommodating chamber.

17. A boat as in claim 1 further comprising:

each said hull having first and second membranes substantially perpendicular to each other; and said membranes defining boundaries of said water accommodating chamber.

* * * * *